US010749268B2

(12) United States Patent
Lynch

(10) Patent No.: US 10,749,268 B2
(45) Date of Patent: Aug. 18, 2020

(54) APERTURE-COUPLED MICROSTRIP ANTENNA ARRAY

(71) Applicant: GM Global Technology Operations LLC, Detroit, MI (US)

(72) Inventor: Jonathan J. Lynch, Oxnard, CA (US)

(73) Assignee: GM Global Technology Operations LLC, Detroit, MI (US)

( * ) Notice: Subject to any disclaimer, the term of this patent is extended or adjusted under 35 U.S.C. 154(b) by 61 days.

(21) Appl. No.: 16/220,590

(22) Filed: Dec. 14, 2018

(65) Prior Publication Data

US 2020/0194901 A1 Jun. 18, 2020

(51) Int. Cl.
*H01Q 21/00* (2006.01)
*H01Q 21/06* (2006.01)
*H01Q 21/08* (2006.01)

(52) U.S. Cl.
CPC ..... *H01Q 21/0075* (2013.01); *H01Q 21/065* (2013.01); *H01Q 21/08* (2013.01)

(58) Field of Classification Search
CPC .. H01Q 21/00; H01Q 21/0075; H01Q 21/065; H01Q 21/08
See application file for complete search history.

(56) References Cited

U.S. PATENT DOCUMENTS 5,694,134 A * 12/1997 Barnes ..... H01G 7/06 343/700 MS
6,377,217 B1 * 4/2002 Zhu ..... H01P 1/181 343/700 MS
2017/0117638 A1 * 4/2017 Kim ..... H01Q 21/0006
2018/0166794 A1 6/2018 Raphaeli et al.
2018/0205134 A1 * 7/2018 Khan ..... H01Q 1/2283

OTHER PUBLICATIONS

Vallecchi et al., "Design of Dual-Polarized Series-Fed Microstrip Arrays With Low Losses and High Polarization Purity", IEEE Transactions on Antennas and Propagation, May 2005, p. 1791-1798, vol. 53, No. 5.
Liu et al., "Packages With Integrated 60-GHz Aperture-Coupled Patch Antennas", IEEE Transactions on Antennas and Propagation, Oct. 2011, p. 3607-3616, vol. 59, No. 10.
(Continued)

*Primary Examiner* — Hoang V Nguyen
(74) *Attorney, Agent, or Firm* — Quinn IP Law

(57) ABSTRACT

A radio frequency (RF) antenna array for an RF printed circuit board (RF-PCB) having a PCB ground layer includes an interposer assembly, conductive pillars, and load element. The interposer assembly includes a substrate, a ground layer defining one or more apertures, a dielectric layer, and a microstrip trace. The substrate is spaced apart from the RF-PCB. The interposer ground layer is deposited onto the substrate. The dielectric layer is deposited onto the interposer ground layer. The microstrip trace, positioned on the dielectric layer, receives and directs incident RF energy along the longitudinal axis. The pillars electrically connect the ground layers and structurally support the substrate, such that RF energy along the trace couples to the upper surface of the interposer assembly through the aperture(s). The load element connects in series to the microstrip trace at a distal/terminal end of the array.

20 Claims, 5 Drawing Sheets

(56) References Cited

OTHER PUBLICATIONS

D. M. Pozar, "Microstrip Antenna Aperturecoupled to a Microstripline", Department of Electrical & Computer Engineering, University of Massachusetts, Amherst, MA 01003, USA, Nov. 19, 1984, Electronics Letters, vol. 21 No. 2.
Nystrom et al., "Reduction of Back Radiation and Cross-Coupling in Dual Polarized Aperture Coupled Patch Antennas", IEEE, Sweden, 1997, p. 2222-2225.
http://www.statschippac.com/~/media/Files/DocLibrary/brochures/STATS_ChipPAC_SiP.ashx, "System-in-Packge (SIP) Solutions", accessed Dec. 6, 2018.

* cited by examiner

APERTURE-COUPLED MICROSTRIP ANTENNA ARRAY

INTRODUCTION

Automated assist systems are used aboard vehicles of various types to help increase comprehensive awareness of objects located in proximity to the vehicle or lying the vehicle's path of travel. Such systems rely on a combination of complementary remote sensing technologies. Core technologies used in operator-driven and emerging autonomously-controlled motor vehicles, for instance, may include radar or lidar systems, optical cameras, as well as vehicle-to-vehicle (V2V)/vehicle-to-everything (V2X) communication devices. Radar systems in particular rely on electromagnetic wave propagation and reflection performing real-time object detection functions. The evolution of radio frequency (RF) transmission and signal processing technologies has fueled corresponding advances in onboard radar systems of the types employed in emerging systems such as adaptive cruise control, automatic braking assistance, obstacle detection, high-beam control, and automatic lane-changing/lane-keeping.

In a typical radar system, a waveform embodying pulsed or continuous-wave RF energy is generated and transmitted in a predetermined scanning direction, such as a forward, lateral, and/or rear direction relative to a vehicle body. If the transmitted waveform encounters a sufficiently reflective object within its bandwidth and propagation range, some of the initially-transmitted RF energy is reflected back toward the RF transmitter as a return signature. The reflected energy is received via an antenna or transceiver, and the corresponding return signature is processed using onboard signal processing hardware and software. In this manner, a radar system is able to quickly determine a direction (i.e., azimuth and elevation) and corresponding range to detected objects located in the vehicle's proximity or path, and ultimately enable control of actuators and/or alerting of an operator responsive to the detection of such objects.

SUMMARY

An improved radio frequency (RF) antenna array is disclosed herein for use with an RF printed circuit board (RF-PCB). Such an RF-PCB may be used as part of a radar assembly in support of an automated driver assist system of the types generally noted above, with the term "driver" referring to human and/or autonomous computer-based/robotic operators of a vehicle. Additionally, the term "assist" may encompass various levels of torque, braking, steering, and/or speed assistance in controlling the vehicle's present operating state or state vector, as well as to activation of audible, visible, and/or tactile warnings to the operator of the vehicle, with or without accompanying vehicle actuator control.

The RF-PCB that is usable with the disclosed RF antenna array includes a major surface onto which is deposited a conductive ground plane layer. This particular layer, which is also referred to herein as the "PCB ground layer" for added clarity, is at least a functional component of the disclosed antenna array. The PCB ground layer may be a structural component of the antenna array in certain embodiments.

The RF antenna array may be optionally configured to operate at sub-terahertz frequencies, such as in the range of about 228-GHz to 240-GHz in a particular embodiment. The antenna array is constructed from one or more antenna elements each having a corresponding aperture through an interposer ground layer. Like the antenna array itself, the various apertures may be rectangular in shape (in plan view), with oval, circular, or other shapes used in other embodiments. The antenna element(s) collectively terminate in a load element, which itself may be configured to dissipate and/or reflect residual RF energy as described below. Incident RF energy directed into the antenna array, such as through a waveguide or other inlet to the antenna array, propagates along the antenna array's longitudinal axis along a single linear microstrip trace.

The axially-propagating RF energy is progressively coupled to the corresponding aperture(s). When multiple apertures are used, the apertures are spaced, e.g., evenly, with respect to each other along the longitudinal axis. The energy coupled to the aperature(s) is radiated away with precise relative amplitude and phase values. Such radiation may be enhanced using a corresponding set of discrete patch antennas as described herein. Excess RF energy remaining at the terminal end of the RF antenna array, i.e., at an outlet end of a downstream-most or serially-last one of the antenna elements, is absorbed and/or reflected through operation of the connected load element.

A multi-layer interposer assembly forms an integral part of the disclosed RF antenna array. The interposer assembly includes a substrate constructed of silicon, ceramic, quartz, organic materials, or another suitable material. The substrate has upper and lower major surfaces respectively corresponding to a top and a bottom of the array. The terms "top" and "bottom" are relative to the normal orientation of the RF antenna array, which would ordinarily be mounted on the vehicle so that the plane of the substrate is perpendicular to the plane of a road surface on which the vehicle is traveling. Deposited onto the lower major surface of the substrate are, in order of progression starting from the lower major surface: a ground plane layer ("interposer ground layer") defining the aperature(s), a dielectric layer, and the above-noted linear microstrip trace, the latter of which is the antenna feed line. The substrate is spaced apart from the RF-PCB by an intervening air gap and structurally supported by conductive pillars, e.g., solid cylindrical pillars of copper or other conductive material. The pillars collectively couple the PCB ground layer to the interposer ground layer, and vice versa. The pillars have corresponding relative positions with respect to the aperture(s) that ultimately help determine the antenna array's frequency performance, while also shielding the aperture(s) to prevent spurious radiation from degrading antenna performance.

The linear microstrip trace, which may take the form of an elongated copper element, wire, or other linear conductor, may slant toward or away from a common centerline of the apertures or longitudinal axis and optional patch antenna(s) along the longitudinal axis. As used herein, "common centerline" means that each aperture has a centerpoint located along the longitudinal axis. For instance, starting at the waveform inlet to the antenna array and continuing along the longitudinal axis, the microstrip trace may gradually slant or taper inward toward the common centerline or longitudinal axis. The level of taper is configured to tune the amount of RF coupling occurring at different points along the longitudinal axis of the antenna array, such as by increasing coupling by tapering the microstrip trace toward the centerline as RF energy propagates toward the load element. Such a taper may be continuous or stepped. Other embodiments may be envisioned in which the respective surface areas or sizes of the one or more apertures and/or of the one or more patch antennas are modified along the longitudinal axis without varying the relative position of the microstrip trace.

The RF antenna array in its various embodiments includes an interposer assembly. The interposer assembly includes a substrate spaced apart from the RF-PCB and having upper and lower major surfaces, an interposer ground layer deposited onto the lower major surface and defining multiple apertures spaced along the longitudinal axis, a dielectric layer deposited onto the interposer ground layer, and a linear microstrip trace positioned on/within the dielectric layer. The microstrip trace directs incident RF energy in a predetermined frequency range along the longitudinal axis, e.g., about 228-GHz to 240-GHz in an example sub-terrahertz embodiment, with "about" meaning "to within ±10 percent" or "to within ±5 percent" in two possible embodiments.

The RF antenna array also includes a plurality of conductive pillars electrically connecting the PCB ground layer to the interposer ground layer while structurally supporting the substrate, such that RF energy propagating along the linear microstrip trace/longitudinal axis is coupled toward and ultimately to the upper major surface of the interposer assembly through the one or more apertures. A load element is connected in series with the linear microstrip trace and located at a distal/terminal end of the antenna array.

The RF antenna array in some embodiments is characterized by an absence of discrete patch antennas. Alternatively, such discrete patch antennas may be deposited onto or otherwise connected to the upper major surface of the substrate, with each respective one of the discrete patch antennas being positioned opposite, i.e., over a footprint or area of, the corresponding aperture, with the aperature formed through the interposer ground layer as noted above.

In a non-limiting example construction, the substrate of the interposer assembly is constructed of silicon, quartz, ceramic, or an organic material, the patch antennas are constructed of copper foil, and the dielectric layer is constructed of bisbenzocyclobutene (BCB).

The load element may be embodied as a serial extension of the linear microstrip trace. For example, a circuitous meander line may include sinuous first and second segments of approximately equal lengths, with the segments positioned on opposing sides of the longitudinal axis. Alternatively, the load element may include a resistor connected in series with the microstrip trace and coupled to an available electrical ground.

As noted above, the linear microstrip trace may taper or angle toward a common centerline of the apertures along the longitudinal axis of the RF antenna array. It is possible that the linear microstrip trace does not ultimately touch or intersect with the longitudinal axis before terminating in the load element.

Some embodiments of the RF antenna array include a plurality of (two or more) spaced apertures, with six or more such aperatures in some embodiments.

A monolithic microwave integrated circuit (MMIC) may be electrically connected to the linear microstrip trace.

In another disclosed embodiment of the RF antenna array, an antenna element or multiple elements collectively terminate in the above-noted load element. Each antenna element has a multi-layer interposer segment, including a substrate segment with upper and lower major surfaces that defines an aperture, a ground layer segment defining the aperature deposited onto the lower major surface of the substrate segment, a dielectric layer segment deposited onto the ground layer segment, and a linear microstrip trace segment positioned on or within the dielectric layer segment. The conductive pillars electrically connect the PCB ground layer and interposer ground layer segment to each other, and structurally support the substrate segment, such that RF energy propagating along the linear microstrip trace is coupled to the upper major surface of each of the various interposer segments through the aperture(s) in each interposer ground layer segment.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of representative embodiments and modes for carrying out the present disclosure when taken in connection with the accompanying drawings and the appended claims.

Figure 1:
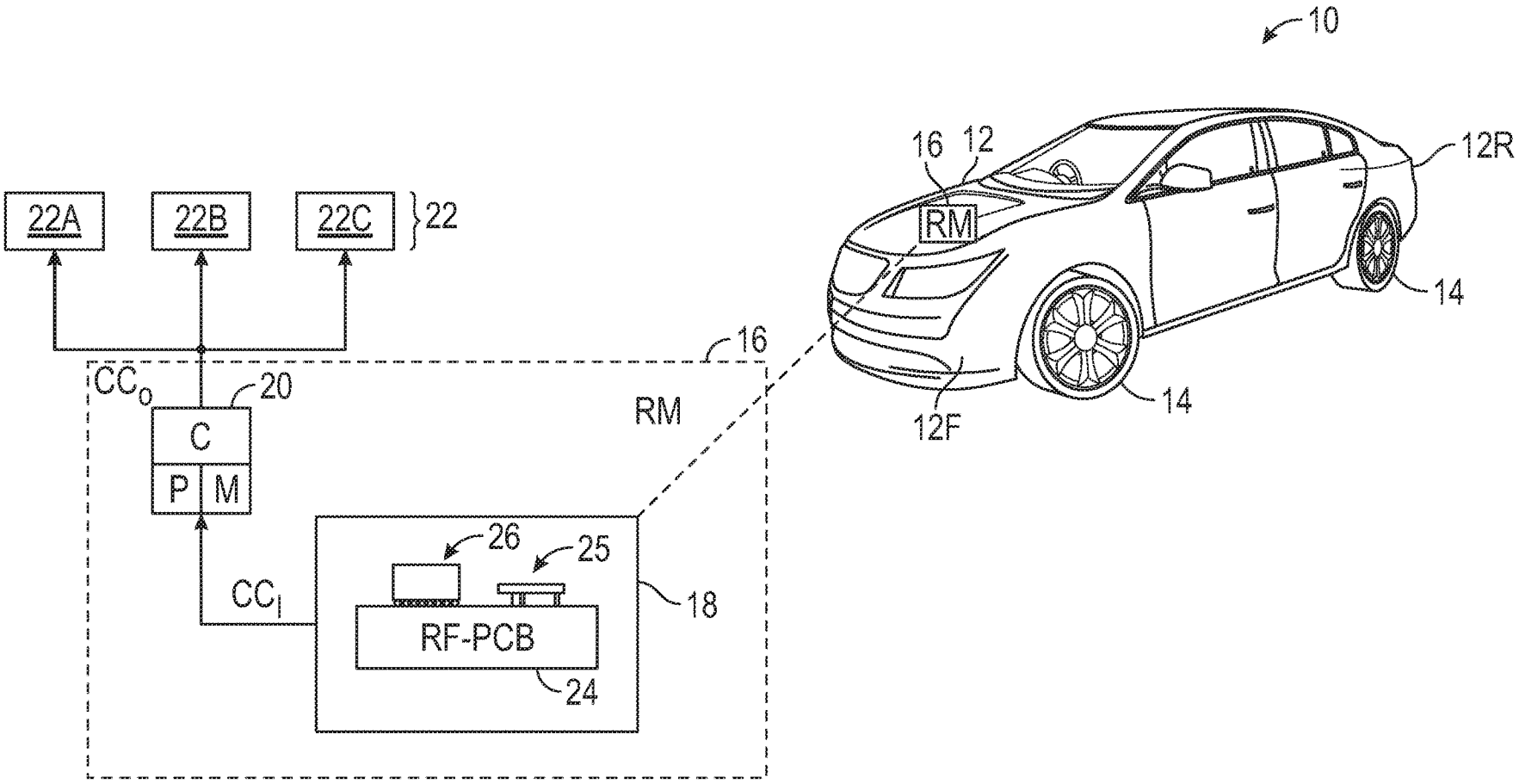
FIG. 1 is a schematic illustration of an example radar system having a radio frequency (RF) antenna array constructed as set forth herein.

The present disclosure is susceptible to various modifications and alternative forms, and some representative embodiments have been shown by way of example in the drawings and will be described in detail herein. It should be understood, however, that the inventive aspects of this disclosure are not limited to the particular forms disclosed. Rather, the disclosure is to cover all modifications, equivalents, combinations, subcombinations, and alternatives falling within the spirit and scope of the disclosure as defined by the appended claims.

DETAILED DESCRIPTION

Referring to the drawings, wherein like reference numbers refer to like components, a vehicle 10 is depicted schematically in FIG. 1. The vehicle 10 includes a vehicle body 12 and, when configured as an example motor vehicle as shown, a set of road wheels 14. Other vehicles 10 may be readily envisioned, for instance rail vehicles, marine vessels, or aircraft, or the vehicle 10 may instead be embodied as a robot, mobile platform, or other system in which the present disclosure may be used to enjoy the noted performance advantages. Therefore, the exemplary embodiment of the vehicle 10 of FIG. 1 is intended to be illustrative of the present teachings and non-limiting unless otherwise specified.

The vehicle 10 is equipped with a radar module (RM) 16, with the radar module 16 having at least one radio frequency (RF) antenna array 25 configured as described in detail below. A given vehicle 10 may include one antenna array 25 for RF transmission function and another antenna array 25 for RF receive function, or a single antenna array 25 may be used with a circulator (not shown), as will be appreciated by those of ordinary skill in the art. The radar module 16 utilizes properties of electromagnetic wave propagation and reflection in a predetermined discrete wavelength or frequency, or a predefined range thereof, to accurately detect the presence of/range to objects located in the expected path of travel of the vehicle 10, or in proximity to the vehicle 10. As such, the radar module 16 may be optionally positioned near a front end 12F of the vehicle body 12, with such a position being advantageous when the radar module 16 is used in support of forward and/or lateral-looking driver assist functions, such as but not limited to adaptive cruise control, automatic braking assistance, high-beam control, lane-changing/lane-keeping systems, etc. Alternatively, the radar module 16 may be positioned elsewhere with respect to the vehicle body 12, such as at a rear end 12R, where the radar module 16 may be used for other beneficial purposes, including but not limited to backup steering, parking, and/or towing assist functions.

The radar module 16 contemplated herein includes a radar assembly 18 and a controller (C) 20. In performing object and/or range detection functions, the radar assembly 18 may transmit control input signals (arrow $CC_1$) to the controller 20, with the control input signals (arrow $CC_1$) being indicative of a detected position of/range to such detected objects. Other information may be conveyed as part of the control input signals (arrow $CC_1$), including for instance the size and identity of the detected obstacle.

In response to receipt of the control input signals (arrow $CC_I$), the controller 20 may transmit control output signals (arrows $CC_O$) to a set of driver assist systems 22, shown for instance as a representative driver assist systems 22A, 22B, and 22C. Example embodiments of the driver assist systems 22A, 22B, and 22C may include one or more of the above-noted adaptive cruise control, automatic braking assistance, obstacle detection, high-beam control, parking or backup assistance, and lane-changing/lane-keeping systems. The controller 20 may be an integral portion of, or a separate module operatively connected to, other resident controllers of the vehicle 10, and variously embodied as one or more digital computers including a processor (P), e.g., a microprocessor or central processing unit, as well as memory (M) in the form of read only memory, random access memory, electrically-programmable read only memory, etc. The controller 20 may also include a high-speed clock, analog-to-digital and digital-to-analog circuitry, input/output circuitry and devices, and appropriate signal conditioning and buffering circuitry.

Still referring to FIG. 1, the radar assembly 18 includes an RF printed circuit board (RF-PCB) 24 to which is mounted the above-noted RF antenna array 25, with the structure and function of the array 25 described in further detail below with reference to FIGS. 2-5. The radar assembly 18 may include other components, such radar integrated circuits (ICs) 26 each having one or more integrated single-chip frequency-modulated continuous-wave (FMCW) transceivers, which in turn are surface-mounted or through-mounted to the RF-PCB 24. Such radar ICs 26 may be configured for operation in an example frequency band of about 76-GHz to 81-GHz in a non-limiting example embodiment, e.g., within ±5 percent or ±10 percent.

Figure 2:
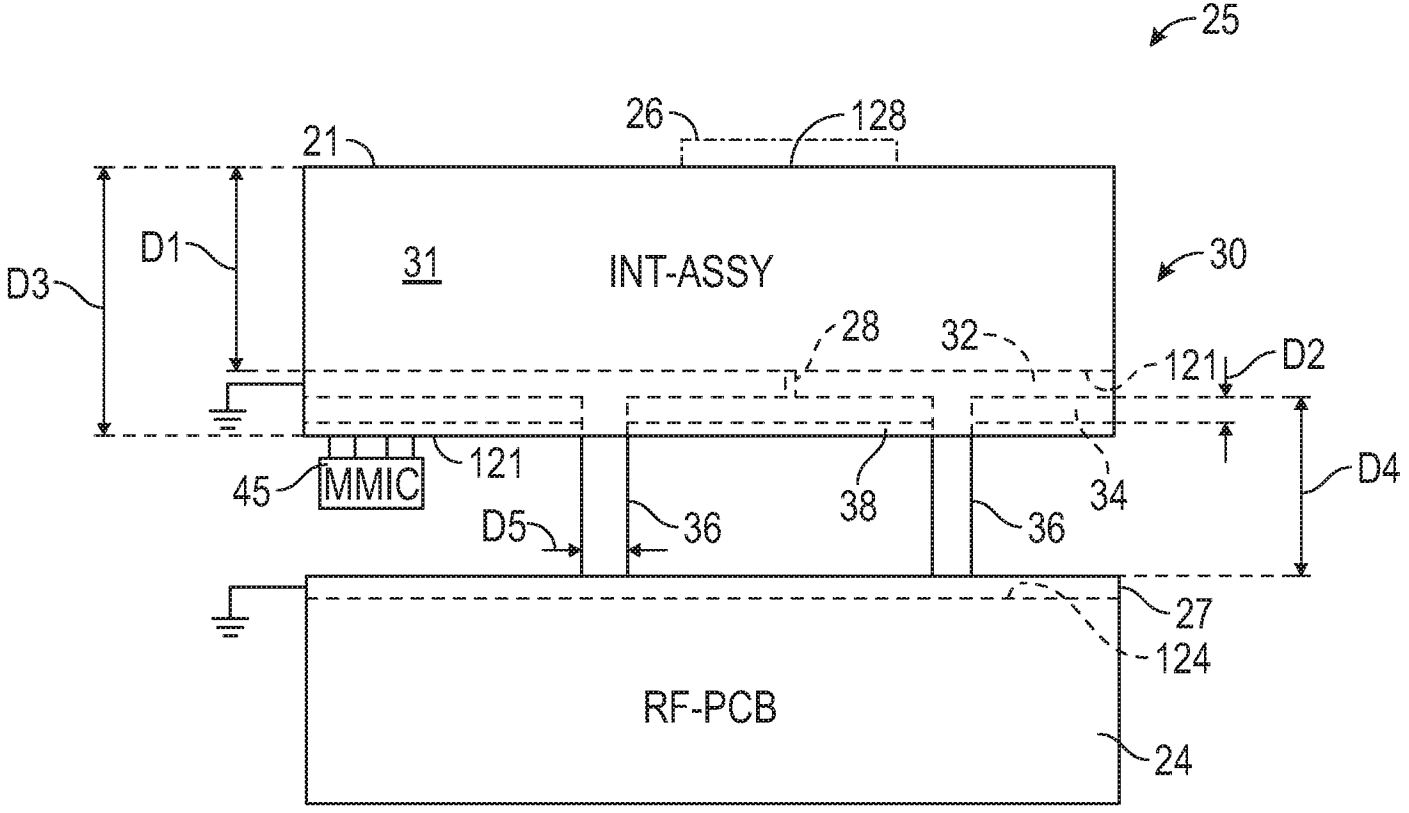
FIG. 2 is a schematic cross-sectional side view illustration of a portion or antenna segment of the RF antenna array shown in FIG. 1.
Figure 3:
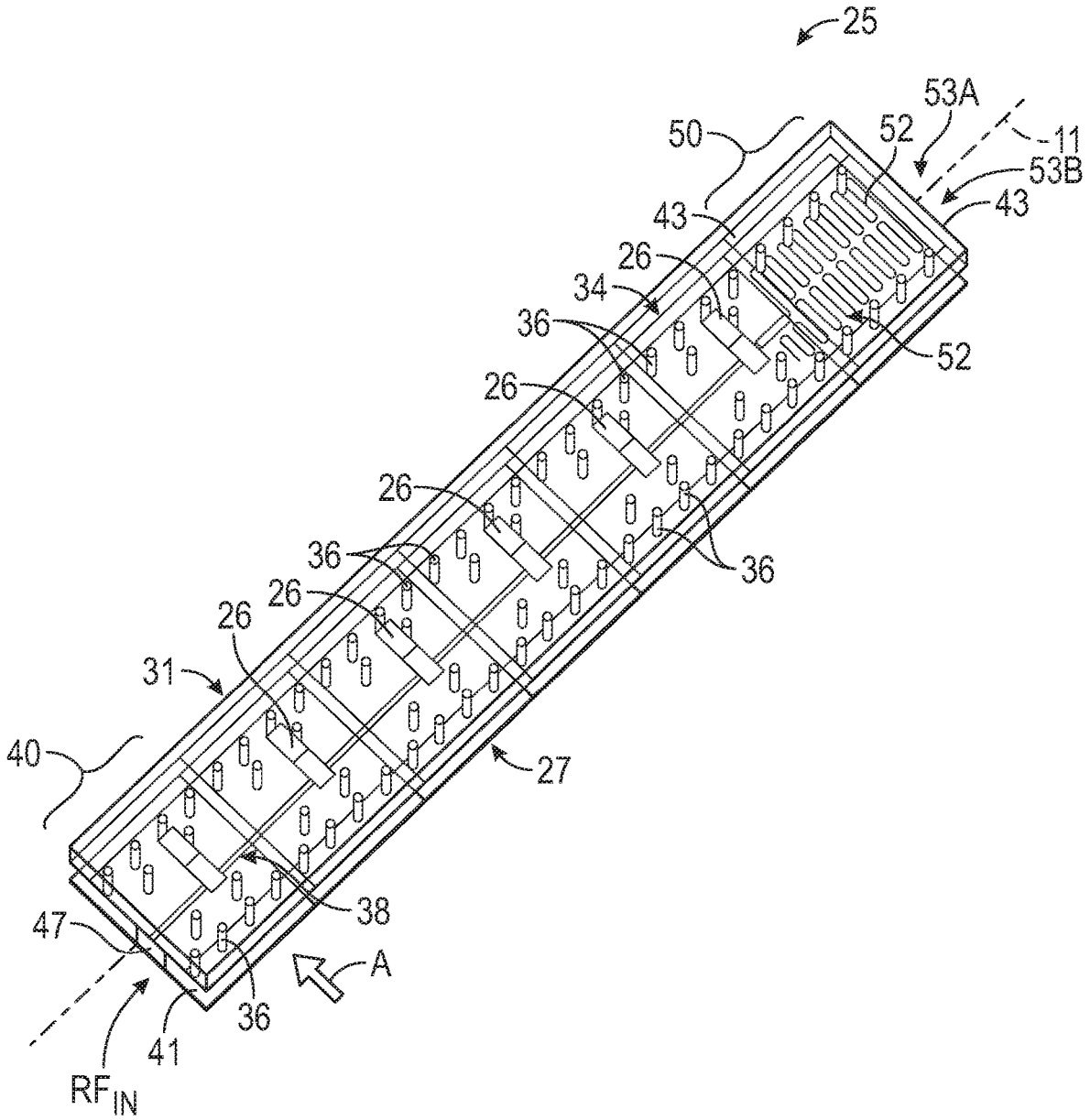
FIG. 3 is a schematic perspective view illustration of an RF antenna array usable as part of the example radar system of FIG. 1.
Figure 4:
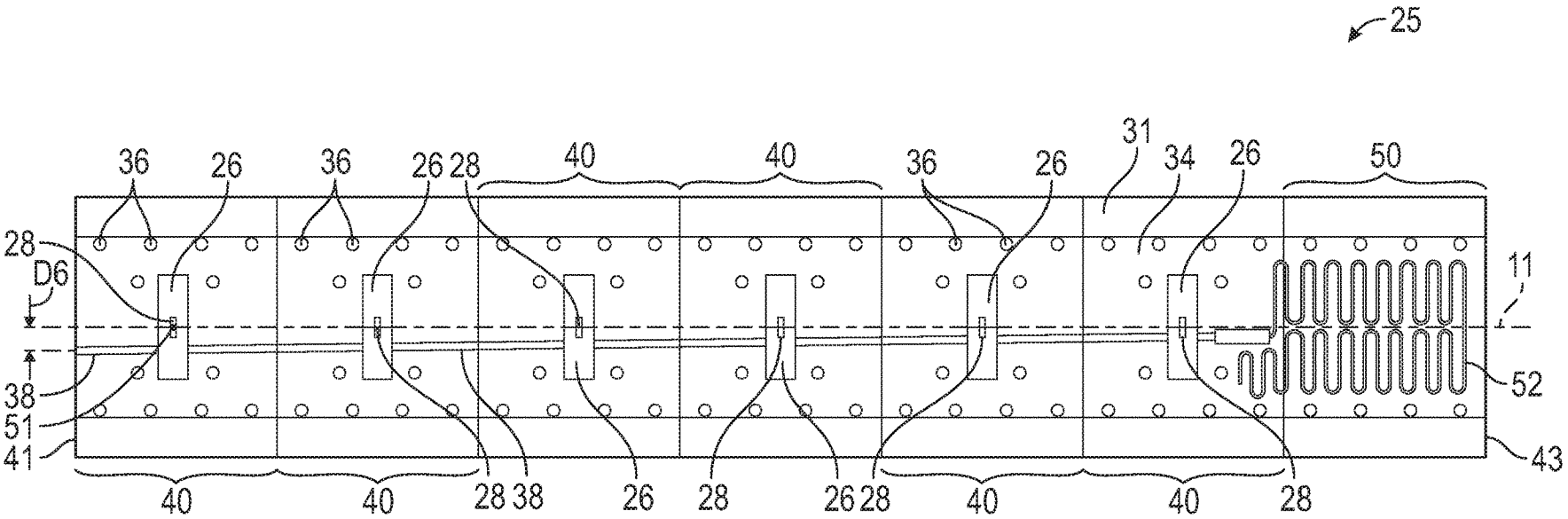
FIG. 4 is a schematic plan view illustration of the RF antenna array shown in FIG. 3

As shown in the schematic side view illustration in FIG. 2, taken from the perspective of arrow A in FIG. 3, the RF-PCB 24 includes or is connected to a first ground plane layer 27, hereinafter the "PCB ground layer" 27. The PCB ground layer 27 is deposited onto or otherwise connected to a first major surface 124 of the RF-PCB 24. The RF antenna array 25, which may operate at about 228-GHz to 240-GHz in a particular embodiment, is constructed of a plurality of serially-connected antenna elements 40 (see FIGS. 3 and 4), with the construction of one such antenna element 40 depicted in FIG. 2. Some embodiments may use just the one antenna element 40, while others may use multiple antenna elements, e.g., six or more. The antenna elements 40 are similarly configured and thus form functional segments of the antenna array 25, but with a subtle structural difference as described below. Each antenna element 40 may optionally include a respective discrete patch antenna 26 positioned over/covering an area or footprint of an aperature 28 in the interposer ground layer 32, with the optional structure shown in a phantom outline. The patch antennas 26 are constructed of suitable conductive material, such as copper foil, and possibly have a rectangular shape in plan view as best shown in FIGS. 3 and 4. Circular, oval, or other application-suitable shapes may be used for the patch antennas 26 within the scope of the disclosure, and thus the particular shape of FIG. 2 is exemplary and non-limiting.

Integral to each RF antenna array 25 is a multi-layer interposer board stack-up, which is hereinafter referred to for simplicity as an interposer assembly (INT-ASSY) 30. The interposer assembly 30 includes a substrate 31 constructed of silicon, ceramic, quartz, an organic material(s), or another application-suitable material. The substrate 31 has upper and lower major surfaces 21 and 121, respectively, corresponding to a top and a bottom of the antenna array 25. The substrate 31 is structurally supported relative to the RF-PCB 24 by a plurality of conductive pillars 36. In some embodiments, the substrate 31 may be fabricated to a thickness or depth (D1) of about 40-50 micrometers (μm). Maximum thickness depends on the materials used to construct the substrate 31, with the thickness or depth (D1) of substrates 31 constructed from organic materials being larger, e.g., about 300 μm, due to their lower dielectric constant. Dimensions smaller than 40-50 μm are possible, down to a lower limit beyond which fabrication of the substrate 31 may be impracticable.

Deposited onto the lower major surface 121 of the substrate 31 is a second ground plane layer, also referred to hereinafter as the above-noted interposer ground layer 32. A dielectric layer 34, such as but not limited to bisbenzocyclobutene (BCB), is deposited onto the interposer ground layer 32, followed by the conductive linear microstrip trace 38. Layer 34 may be about 10-15 μm thick in a possible embodiment, with such a dimension shown for the dielectric layer 34 as a corresponding thickness or depth (D2). Although shown with a slightly exaggerated thickness in FIG. 2, the microstrip trace 38 is substantially thinner, e.g., about 1 μm, and thus provides a negligible contribution to the overall thickness or depth (D3) of the interposer assembly 30. Thus, the overall thickness or depth (D3), inclusive of the substrate 31, may be about 60-65 μm in a possible embodiment, without necessarily limiting the relative or absolute thicknesses to the stated values.

The microstrip trace 38 may be deposited or formed on the dielectric layer 34, with portions of the aperatures 28 being etched into/through the interposer ground layer 32. As explained below, RF energy admitted into the RF antenna array 25 and propagating along the length of the microstrip trace 38 is coupled to a respective one of the apertures 28, with the apertures 28 defined by the surrounding structure only of the ground layer 32. A single linear microstrip trace 38 is thus fed into each subsequent antenna element 40 arranged in series. A total amount of incident RF energy entering the antenna array 25 progressively decreases along a longitudinal axis 11 of the array 25 via radiation and transmission along the microstrip trace 38, with the longitudinal axis 11 best shown in FIGS. 3 and 4.

Each of the above-noted conductive pillars 36 may be cylindrical, and thus possess a circular cross-section and a height dimension (D4) of about 70-80 μm in an example embodiment using the above-noted example dimensions (D1, D2, and D3). The pillars 36 may have a diameter (D5) of about 45-55 μm in such an embodiment. In addition to structurally supporting and spacing the substrate assembly 31 with respect to the RF-PCB 24, the various pillars 36 extend between and electrically short the interposer ground layer 32 to the PCB ground layer 27, thus preventing propagation of RF energy between the ground layers 27 and 32. While the PCB ground layer 27 is in certain embodiments an integral structural component of the RF-PCB 24, the PCB ground layer 27 is considered an integral functional component of the RF antenna assembly 25. Thus, the PCB ground layer 27 may be coupled to the conductive pillars 36 before or after being connected to the RF-PCB 27.

Ordinarily, RF energy propagates along the linear microstrip trace 38 and falls incident upon the apertures 28 in the interposer ground layer 32, where the incident RF energy thereafter radiates in both directions between a location of the optional surface-mounted patch antennas 26 on surface 21 and a location of the microstrip trace 38 between the ground plane layers 32 and 37. When a given aperture 28 is excited by the RF energy of the microstrip trace 38, the aperture 28 will tend to radiate in both a front (upward) and a back (downward) direction as viewed from the side perspective of FIG. 2. The term "parallel plate mode" refers to energy radiated from the aperature 28 on the PCB-side of the array 25, with such energy trapped between the ground plane layers 32 and 37 and propagating outward from the slot. The pillars 36 prevent such a mode by shorting the two ground planes 32 and 37 together.

The conductive pillars 36 of FIG. 2 are arranged with respect to the apertures 28, with a possible arrangement shown in FIG. 4. While two pillars 36 are shown in FIG. 2, the actual number of pillars 36 surrounding the various apertures 28, and the actual number of aperatures 28, will vary with the operating frequency of the RF antenna array 25. For instance, twelve such pillars 36 may be used in each discrete antenna element 40 in the example embodiment of FIGS. 3 and 4. A separation distance between a given one of the pillars 36 and the aperture 28 of a corresponding antenna element 40 should be close enough not to excite higher-order modes, i.e., less than half wavelength, or typically a quarter wavelength, away from the aperature 28. Separation of adjacent pillars 36 is likewise important, and should also be less than a half wavelength. Accordingly, the separation distances are highly design-specific. Thus, both the structure and location of the pillars 36 is tailored to meet a desired frequency performance of the array 25 as a whole.

The microstrip trace 38 may be connected in some embodiments to a monolithic microwave integrated circuit (MMIC) 45. The MIMIC 45 may be connected directly to the microstrip trace 38 as shown, i.e., between the interposer assembly 30 and the RF-PCB 24, or the MMIC 45 may be mounted to the upper major surface 21 of the interposer assembly 30 and connected to the microstrip trace 38 using conductive through-vias (not shown). Regardless of the position of the MIMIC 45, the MIMIC 45 may be used to transmit 78-GHz transmit signals to the RF-PCB 24 in certain configurations, with the RF-PCB 24 then up-converting or frequency-multiplying the transmitted 78-GHz signals to the signals of a desired frequency, e.g., 228-GHz to 240-GHz. The higher-frequency signals are then broadcast or transmitted by operation of the RF antenna array 25. The opposite action may be taken by the MIMIC 45 to down-convert received 228-GHz to 240-GHz signals to lower-frequency signals, e.g., 77-GHz or 78-GHz, for subsequent processing by the RF-PCB 24. As a result, the example radar assembly 18 of FIG. 2 may be used to produce a 228-GHz to 240-GHz radar system for beneficial use aboard the vehicle 10 of FIG. 1 or in other applications.

The RF antenna array 25 of FIGS. 1 and 2 is shown schematically in FIG. 3 as an elongated array of serially-connected antenna elements 40 collectively terminating in a load element 50. As noted above, a single antenna element 40 may be used with the load element 50 in some configurations. Each antenna element 40 has the same components, which while constructed as a unitary whole, may be thought of as "segments" constructed as shown in FIG. 2. Thus, each antenna element 40 is defined by a segment of the interposer assembly 30, and thus has a corresponding segment of the substrate 31, the interposer ground layer 32, the dielectric layer 34, and the linear microstrip trace 38, and some of the pillars 36. Incident RF energy (arrow $RF_{IN}$) is directed into the antenna array 25, e.g., through a waveguide 47 disposed at an inlet end 41 of the antenna array 25. RF energy that propagates along the length of the microstrip trace 38 toward the load element 50 is progressively coupled to the apertures 28 (see FIG. 4), and to the corresponding patch antennas 26 when such patch antennas 26 are used. The coupled energy is thereafter radiated away from the apertures 28/patch antennas 26 at a calibrated frequency/wavelength or band thereof. In this manner, most of the incident RF energy (arrow $RF_{IN}$) that is directed into the antenna array 25, e.g., 90 percent or more of the incident RF energy, is radiated away prior to reaching the terminal or distal end 43 of the array 25 prior to reaching the load element 50.

Excess RF energy remaining in the RF antenna array 25 at the distal end 43 may be partially reflected and dissipated through operation of the load element 50, which is a serial extension of the microstrip trace 38. That is, the load element 50 is specifically designed to reflect some RF energy with a particular reflection coefficient, which also includes a dissipative portion. The meander line 52 is thinner than/not as wide as the antenna feed line, i.e., the microstrip trace 38, which helps create the desired reflection coefficient. The value of the load reflection coefficient is determined as part of the design of the antenna array 25. It is also possible to design the antenna array 25 with a load that reflects all of the energy back, but this typically reduces the operating bandwidth of the antenna array 25.

In a possible embodiment, the load element 50 may include a circuitous meander line 52, e.g., a sinuous terminal extension of the linear microstrip trace 38 having a calibrated length suitable for dissipating the remaining RF energy. Thus, "sinuous" as used herein has the contect of multiple curves in alternating directions, "circuitous" refers to an extended path of a particular pattern, including a random one.

Figure 3A:
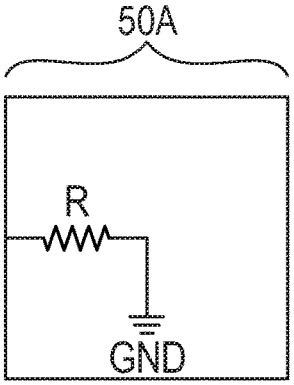
FIG. 3A is a schematic plan view illustration of an optional embodiment of a load element usable with the RF antenna array of FIG. 3.

For instance, the load element may include a pair of sinuous dissipative segments 53A and 53B positioned on opposing sides of the longitudinal axis 11, and thus with approximately equal lengths. The total length of the meander line 52 and/or each of the segments 53A and 53B is thus substantially greater than the individual straight-line lengths of the segments of linear microstrip trace 38 within a given one of the antenna elements 40, e.g., 2-4 times longer. As the wave travels down the meander line 52 in this embodiment, power is dissipated away, thus preventing power from reflecting back toward the antenna elements 40. Alternative configurations of the load element 50 that may function in a similar manner include, as shown in FIG. 3A as an alternative load element 50A, a resistor (R)-to-ground (GND) connection, where the resistor (R) is serially connected to the microstrip trace 38 and to a conveniently located electrical ground. As noted above, the load element 50 could also be configured as a reflector to accomplish the desired functions.

Figure 5:
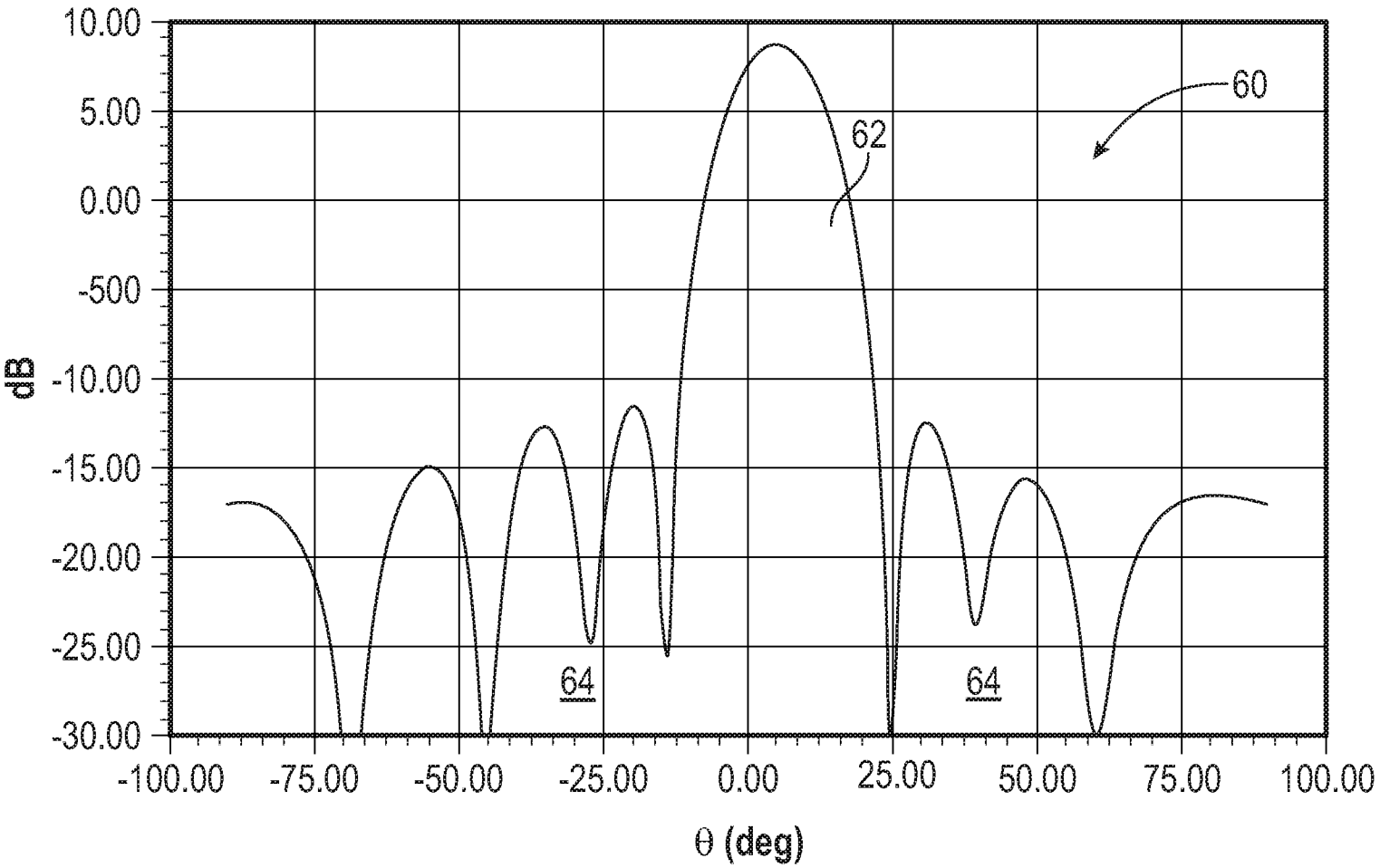
FIG. 5 is a plot of realized gain (vertical axis) versus pattern angle (horizontal axis) depicting performance at 234-GHz of the example RF antenna array of FIGS. 3 and 4.

Referring to FIG. 4, the RF antenna array 25 may be configured with subtle differences along its longitudinal axis 11 to provide a desired frequency performance. Radiation pattern sidelobes, examples of which are shown in FIG. 5 as described below, may be controlled by arranging an axis of the microstrip trace 38 at a progressively changing distance (D6) with respect to the longitudinal axis 11 or centerline 51. A desired level of RF coupling is accomplished by moving the microstrip trace 38 slightly off of the aperture centerline 51, with the microstrip trace 38 located farthest away from the centerline 51 in a first one of the antenna elements 40 in the array 25, and gradually moving closer to the centerline 51 in a last one of the antenna elements 40 in the array 25, i.e., the antenna element 40 located immediately adjacent to the load element 50. The change in distance (D6) need not be linear along the axis 11. An effect of such a taper level is stronger RF coupling and increased radiation through the respective apertures 28 as the RF energy propagates along the microstrip trace 38 away from the inlet. With the common centerline 51 of the various apertures 28 coaxially-aligned with the longitudinal axis 11 of the RF antenna array 25, the amount of such taper, not necessarily shown to scale in FIG. 4, may be less than 5-degrees in an embodiment in which the taper is continuous along the longitudinal axis 11, or the taper may vary in a stepped manner or discretely at each of the antenna elements 40.

FIG. 5 depicts an exemplary plot 60 showing a possible antenna lobe pattern resulting from a simulation of the RF antenna array 25 of FIGS. 1-4. Realized gain in decibels (dB) is depicted on the vertical axis, with a beam angle (0) in degrees depicted on the horizontal axis for an example RF performance at 234-GHz. With Z being the particular Cartesian axis arranged normal to the plane of the patch antennas 26, for instance, and X being the axis of the microstrip trace 38, then the angle (θ) lies in the XZ plane. Effective control of the sidelobes 64 is depicted, i.e., about 20 dB below the nominal gain of the main lobe 62. Realized gain is about 8.5 dB in this particular embodiment, with a return loss of greater than 10 dB.

Alternative configurations of the RF antenna array 25 are possible, as will be appreciated by one of ordinary skill in the art in view of the foregoing disclosure. For example, as noted above, it is possible to eliminate the patch antennas 26 and allow the apertures 28 in the interposer ground layer 32 to radiate directly. In such an embodiment, the RF antenna array 25 and the individual antenna elements 40 are characterized by an absence of the patch antennas 26, such that the apertures 28 function as slot-radiators 128. Such an approach has the potential advantage of simplifying the fabrication process, with the need for metal patterning on the upper major surface 21 of the interposer assembly 30 being eliminated. A potential disadvantage is that the bandwidth of the apertures 28 embodied as slot-radiators 128 may not be as wide relative to configurations employing the patch antennas 26. However, it may still be possible to achieve application-suitable bandwidths using such an optional slot-radiator 128 configuration.

Other embodiments may include metalized vias through the interposer assembly 30 to isolate the antenna elements 40. While vias of this type may increase cost and fabrication complexity, the use of such vias may cut down surface waves that may be excited by the patch antennas 26. Such surface waves may tend to reduce the radiation efficiency of the patch antennas 26 and create ripples in the radiation patterns. The use of vias through the interposer assembly 30 also enables the use of a thicker substrate 31, which in turn may reduce fabrication costs. The forgoing description thus collectively describes a usable structure that integrates commercially-available radar ICs with front-end ICs and the present RF antenna array 25 in a manner that is amenable to low-cost, high-volume manufacturing of a radar system 18 operating at frequencies above 100-GHz, e.g., 234-GHz.

While some of the best modes and other embodiments have been described in detail, various alternative designs and embodiments exist for practicing the present teachings defined in the appended claims. Those skilled in the art will recognize that modifications may be made to the disclosed embodiments without departing from the scope of the present disclosure. Moreover, the present concepts expressly include combinations and sub-combinations of the described elements and features. The detailed description and the drawings are supportive and descriptive of the present teachings, with the scope of the present teachings defined solely by the claims.

What is claimed is:

1. A radio frequency (RF) antenna array for use with an RF printed circuit board (RF-PCB) having a PCB ground layer, the RF antenna array having a longitudinal axis and comprising:

an interposer assembly comprising:

a substrate spaced apart from the RF-PCB, and having an upper major surface and a lower major surface;

an interposer ground layer deposited onto the lower major surface of the substrate and defining one or more apertures along the longitudinal axis;

a dielectric layer deposited onto the interposer ground layer; and a linear microstrip trace configured as an antenna feed line and positioned on the dielectric layer, wherein the linear microstrip trace is configured to direct incident RF energy of a predetermined frequency range along the longitudinal axis;

a plurality of conductive pillars electrically connecting the PCB ground layer to the interposer ground layer and structurally supporting the substrate, such that the RF energy propagating along the linear microstrip trace is coupled to the upper major surface of the interposer assembly through the one or more apertures; and a load element connected in series with the linear microstrip trace at a terminal end of the RF antenna array.

2. The RF antenna array of claim 1, wherein the RF antenna array is characterized by an absence of discrete patch antennas.

3. The RF antenna array of claim 1, further comprising: at least one discrete patch antenna connected to the upper major surface of the substrate opposite a corresponding one of the aperatures.

4. The RF antenna array of claim 3, wherein the substrate is constructed of silicon, quartz, ceramic, or organic material, the at least one discrete patch antenna is constructed of copper foil, and the dielectric layer is constructed of bis-benzocyclobutene (BCB).

5. The RF antenna array of claim 1, wherein the load element is a circuitous meander line forming a serial extension of the linear microstrip trace, and wherein the circuitous meander line is thinner than the linear microstrip trace.

6. The RF antenna array of claim 5, wherein the circuitous meander line has sinuous first and second segments of approximately equal lengths, the first and second segments being positioned on opposing sides of the longitudinal axis.

7. The RF antenna array of claim 5, wherein the load element includes a resistor connected in series with the linear microstrip trace and coupled to an electrical ground.

8. The RF antenna array of claim 1, wherein the linear microstrip trace tapers toward a common centerline of the at least one aperture and the load element along the longitudinal axis of the RF antenna array.

9. The RF antenna array of claim 1, wherein the one or more apertures includes a plurality of aperatures spaced apart from each other along the longitudinal axis.

10. The RF antenna array of claim 1, wherein the predetermined frequency range is about 228-GHz to 240-GHz.

11. The RF antenna array of claim 1, further comprising the PCB ground layer.

12. The RF antenna array of claim 1, wherein the aperatures have a rectangular shape in a plan view, and wherein the pillars are cylindrical.

13. The RF antenna array of claim 1, further comprising a monolithic microwave integrated circuit (MMIC) electrically connected to the linear microstrip trace.

14. A radio frequency (RF) antenna array for use with an RF printed circuit board (RF-PCB) having a PCB ground layer, the RF antenna array having a longitudinal axis and comprising:

a load element;

one or more antenna elements collectively terminating in the load element, each of the one or more antenna elements having:

a multi-layer interposer segment comprising:

a substrate segment having upper and lower major surfaces;

a ground layer segment deposited onto the lower major surface of the substrate segment and defining an aperture;

a dielectric layer segment deposited onto the ground layer segment;

a linear microstrip trace segment positioned on or within the dielectric layer segment, and configured to direct incident RF energy in a frequency range of at least about 228-GHz along the longitudinal axis toward the load element, wherein the linear microstrip trace segment is not parallel to the longitudinal axis of the RF antenna array; and a plurality of conductive pillars electrically connecting the PCB ground layer to the ground layer segment, and structurally supporting the substrate segment, such that the RF energy propagating along the linear microstrip trace is coupled to the upper major surface of the interposer segments through the aperture.

15. The RF antenna array of claim 14, wherein the RF antenna assembly is characterized by an absence of discrete patch antennas.

16. The RF antenna array of claim 14, wherein the RF antenna array includes a serially-connected plurality of the antenna elements.

17. The RF antenna array of claim 14, wherein the multi-layer interposer segment includes a discrete patch antenna connected to the upper major surface of the substrate segment opposite the aperture.

18. The RF antenna array of claim 14, wherein the load element includes a circuitous meander line forming a sinuous extension of the linear microstrip trace.

19. The RF antenna array of claim 14, wherein the linear microstrip trace segment tapers or angles toward the longitudinal axis.

20. The RF antenna array of claim 14, further comprising a monolithic microwave integrated circuit (MMIC) that is electrically connected to the linear microstrip trace.

* * * * *